US010662551B2

(12) United States Patent
Rohm et al.

(10) Patent No.: US 10,662,551 B2
(45) Date of Patent: May 26, 2020

(54) SPINNING BEAM FOR PRODUCING MELT-SPUN FILAMENTS

(71) Applicant: TRUETZSCHLER GMBH & CO. KG, Moenchengladbach (DE)

(72) Inventors: Wolfgang Rohm, Grossostheim (DE); Karl-Heinz Sandritter, Sinsheim (DE); Michael Lüttinger, Winterthur (CH)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 253 days.

(21) Appl. No.: 15/542,406

(22) PCT Filed: Nov. 18, 2015

(86) PCT No.: PCT/EP2015/002301

§ 371 (c)(1),
(2) Date: Jul. 7, 2017

(87) PCT Pub. No.: WO2016/110300

PCT Pub. Date: Jul. 14, 2016

(65) Prior Publication Data

US 2017/0350039 A1 Dec. 7, 2017

(30) Foreign Application Priority Data

Jan. 8, 2015 (DE) ..... 10 2015 100 179

(51) Int. Cl.
*D01D 1/06* (2006.01)
*D01D 4/06* (2006.01)
(Continued)

(52) U.S. Cl.
CPC ..... *D01D 1/06* (2013.01); *D01D 4/00* (2013.01); *D01D 4/06* (2013.01); *D01D 5/08* (2013.01);
(Continued)

(58) Field of Classification Search
CPC .. D01D 1/06; D01D 4/00; D01D 4/02; D01D 4/06; D01D 5/08; D01D 5/082; D01D 4/08; D01D 13/02
(Continued)

(56) References Cited

U.S. PATENT DOCUMENTS 3,655,314 A 4/1972 Lenk et al.
5,866,050 A * 2/1999 Krauss ..... D01D 1/09 264/40.6
(Continued)

FOREIGN PATENT DOCUMENTS

CN 101550611 B 12/2010
EP 2122019 B1 11/2010
(Continued)

OTHER PUBLICATIONS

International Search Report for PCT/EP2015/002301, dated Dec. 23, 2015, and English Translation thereof.
(Continued)

*Primary Examiner* — Joseph S Del Sole
*Assistant Examiner* — Lawrence D. Hohenbrink, Jr.
(74) *Attorney, Agent, or Firm* — FisherBroyles, LLP; Robert Kinberg

(57) ABSTRACT

A spinning beam for producing melt-spun filaments, in which liquid plastics material is conveyed via an externally arranged extruder to at least one pump, which conveys the liquid plastics material to at least one spin pack having a spinneret, at least the pump and the spin pack being heated by a heat transfer medium which is heated in a boiler. The pump, the boiler and an opening for receiving a spin pack are arranged in a modular assembly, which can be installed and fixed singly, or in a plurality one behind the other, in a frame of the spinning beam.

7 Claims, 4 Drawing Sheets

(51) Int. Cl.

| | |
|---|---|
| ***D01D 5/08*** | (2006.01) |
| ***D01D 4/00*** | (2006.01) |
| *D01D 4/08* | (2006.01) |
| *D01D 4/02* | (2006.01) |
| *D01D 13/02* | (2006.01) |

(52) U.S. Cl.
CPC ..... *D01D 4/02* (2013.01); *D01D 4/08* (2013.01); *D01D 5/082* (2013.01); *D01D 13/02* (2013.01)

(58) Field of Classification Search
USPC ..... 425/378.2
See application file for complete search history.

(56) References Cited

U.S. PATENT DOCUMENTS 6,083,432 A 7/2000 Schafer
6,736,624 B1 * 5/2004 Tietze ..... D01D 1/09 425/192 S
7,172,399 B2 * 2/2007 Reutter ..... D01D 1/09 264/169
2010/0015266 A1 1/2010 Schuett et al.

FOREIGN PATENT DOCUMENTS

KR 10-1998-0024331 A 7/1998
KR 10-2002-0077658 A 10/2002

OTHER PUBLICATIONS

Written Opinion for PCT/EP2015/002301, dated Dec. 23, 2015.
Notification of Reason for Refusal issued in corresponding Korean Patent Application No. 10-2017-7022068 (submitting English language translation only).

* cited by examiner

SPINNING BEAM FOR PRODUCING MELT-SPUN FILAMENTS

CROSS-REFERENCE TO RELATED APPLICATIONS

This application is a U.S. National Stage of International Patent Application No. PCT/EP2015/002301 filed Nov. 18, 2015, designating the United States and claiming benefit of German Patent Application No. 10 2015 100 179.9 filed Jan. 8, 2015.

BACKGROUND OF THE INVENTION

The invention relates to a spinning beam for producing melt-spun filaments.

Known spinning beams have spinneret packs which are arranged in rows on the underside of the spinning beam. Depending on the size of the installation, a plurality of spinning beam modules are fixedly arranged side by side and are fixedly connected to one another via pipes for the heat transfer medium. The large space requirement of the spinning beam modules arranged side by side is dependent on the mounting position of the heating rods and pump, which can be maintained and, if necessary, replaced only with great difficulty, because there must be sufficient space for that purpose between the spinning beam modules. Adaptation to an increased installation capacity is possible only with great outlay.

EP 2122019 B1 discloses a device for melt spinning synthetic elements, in which the spinning pump is arranged on a separate pump support which is arranged at a distance from the housing of the spinning beam. This results in a very large distance between the pump and the spinneret, which is associated with the technological disadvantage of a longer dwell time and, owing to the space requirement, makes a possible enlargement of the installation feasible only with a high outlay.

SUMMARY OF THE INVENTION

An object of the present invention is to simplify the known spinning beams in terms of construction, to permit easier access for maintenance of the pump with, at the same time, a compact construction.

The above and other objects are achieved by a spinning beam for producing melt-spun filaments, in which liquid plastics material is conveyed via an externally arranged extruder to at least one pump, which conveys the liquid plastics material to at least one spin pack having a spinneret, wherein at least the pump and the spin pack are heated by a heat transfer medium which is heated in a boiler.

According to an embodiment, the pump, the boiler and an opening for receiving a spin pack are arranged in a modular assembly, which can be installed and fixed singly, or in a plurality one behind the other, in a frame of a spinning beam.

The spinning beam can thus be enlarged by further spin packs as desired, so that the capacity of the installation can very easily be adapted to increasing production.

The modular assembly may have a suspension which comprises at least two cross-members. The cross-members may be of such a size that they can be installed in the frame of the spinning beam. The assembly as a whole is mounted on the cross-members.

According to another embodiment, the cross-members are connected to at least one heat chamber in such a manner that an opening for receiving at least one spin pack is formed.

The cross-members and the heat chamber thus form a frame in which the openings for receiving the spin packs are arranged. Connection of the cross-members to the heat chambers results in a supporting frame to which all the other components of the modular assembly can be fixed.

The pump may be arranged horizontally and transversely, or perpendicularly, to a long side of the frame. The pump can thus be maintained from a service passage of the framework without extensive disassembly work being necessary.

According to a further embodiment, the boiler is arranged horizontally and transversely, or perpendicularly, to a long side of the frame. The two measures, namely the horizontal arrangement of the boiler and of the pump perpendicularly to the long side of the frame, permit a more compact construction of the spinning beam, since no space is required between the spin packs, or between the assemblies, for maintenance of the two components. Maintenance is carried out solely from the service passage of the framework, which has sufficient space for changing the long heating rods and the pumps. In this arrangement of the boiler, the space requirement for the individual assemblies is reduced, so that, with a smaller spacing, the pipes for the liquid plastics material can also be made shorter. The lateral arrangement of the boiler also permits good access to the pump and to the monomer extraction system. The available space between the blow shafts is used for the boiler, so that no additional floor space is required on the steel platform for a separate boiler. The arrangement of the boiler permits small spacing, since the heating rods lie at approximately 90° to the axis of the spinning beam.

The pump and the boiler do not have to be arranged exactly at right angles to the longitudinal carrier. A slightly inclined arrangement, for example at 75°, of the longitudinal axis of the boiler and of the pump relative to the longitudinal carrier, at which the components, for example the heating rods, can be replaced via the service passage, would also fall under the term transversely or perpendicularly. In the prior art, the pump and the boiler are arranged to be disassembled between the spin packs, so that the distance between the spin packs is determined by the space required to disassemble the replaceable components. According to this invention, the spinning beams can be arranged very close to one another, which makes the installation as a whole more compact and shortens the pipes carrying the melt, which has the process-related advantage of a shorter dwell time for the liquid plastics material.

The pump may be driven by a drive by means of a shaft, the drive being arranged on a framework outside the spinning beam. By disassembling the shaft, the pump becomes very readily accessible and can easily be disassembled by loosening a small number of screws.

By arranging a plurality of modular assemblies to form a spinning beam, all the boilers are connected by means of pipes to a vacuum station and a condenser. Especially because the boilers are connected to one another by means of a pipe, a system of communicating pipes is formed, so that an identical heating situation is obtained for each modular assembly.

According to a further embodiment, the supplying of liquid plastics material to the pumps is achieved by at least one pipe via a flange connection, the pipes being arranged vertically. Deposits of liquid plastics material of different viscosity are thus unable to form. In contrast to the prior art, the design permits short melt lines with correspondingly short dwell times for the liquid plastics material.

BRIEF DESCRIPTION OF THE DRAWINGS

The invention will be explained in greater detail with reference to the accompanying drawings, in which.

DETAILED DESCRIPTION OF THE INVENTION

Figure 1:
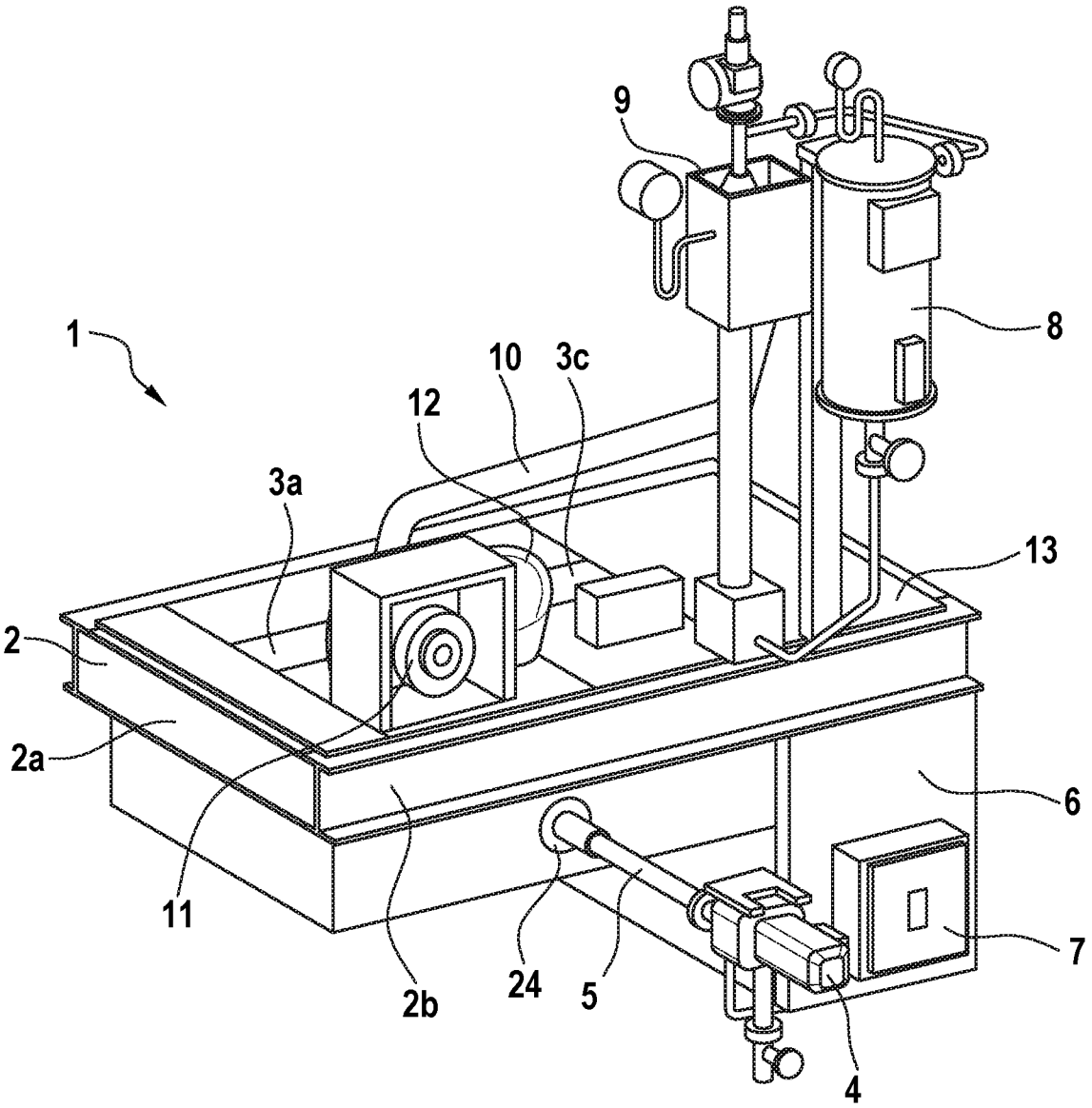
FIG. 1 is a perspective view of a spinning beam of modular construction.

FIG. 1 shows a spinning beam 1 of modular construction which has a peripheral frame 2 on which all the important components are arranged or fixed. The frame 2 is formed by a peripheral U- or double-T-shaped carrier, in which a modular assembly 20*a* (FIG. 2) can be mounted or installed. The frame 2 is of rectangular construction and has two narrow sides 2*a* and two long sides 2*b*. Openings 23*a*, 23*b*, 23*c* for spin packs which are to be installed are arranged inside the modular assembly 20*a* and can be closed by covers 3*a*, 3*b*, 3*c* and insulators, which are arranged on the frame 2. Outside the spinning beam 1 there is arranged a drive 4 for a pump 24, it being possible for the drive 4 to be connected to the pump 24 via a shaft 5. The pump 24 is arranged horizontally and transversely, or perpendicularly, to the long side of the spinning beam 1 and conveys the liquid plastics material through the nozzles of the spin packs. The drive 4 can be arranged outside the frame 2 on a framework which receives the spinning beam 1 of modular construction. Also arranged inside the spinning beam 1 is a boiler 25, which receives Diphyl, for example, as the heating medium. For heating the heat transfer medium, openings 26 are provided in the boiler 25, into which openings heating rods can be pushed. Both the boiler 25 and the openings 26 for the heating rods are closed to the outside by a respective cover 6, 7. Above the spinning beam 1 there is mounted a vacuum station 8 with a condenser 9, which are connected via a pipe 10 to a heat chamber 27*a*. The heat chamber 27*a* corresponds with at least one further heat chamber 27*b*, so that the spinnerets are enclosed on at least two sides, a circulating flow of the heating medium between the vacuum station 8, the heat chambers 27*a*, 27*b* and the boiler 25 being formed. Both the condenser 9 and the vacuum station 8 are fixed with their auxiliary components to the spinning beam 1. A heat transfer medium, for example Diphyl, is converted into a vapour state inside the boiler 25 by the heating rods, so that the vapour flows through the heat chambers 27*a*, 27*b*. A condensate that forms inside the heating circuit is guided back to the vacuum station 8 and to the condenser 9 via condensate lines.

FIG. 1 further shows a flange connection 11 for a pipe, via which liquid plastics material from an externally arranged extruder is conveyed to the pump 24. The flange connection 11 is likewise fixed to the spinning beam 1 and connected by means of pipes 12 to the pump 24 and the spinnerets. The spinning beam 1 further has a surface which can be walked on, beneath which an insulator 13 is arranged.

Figure 2:
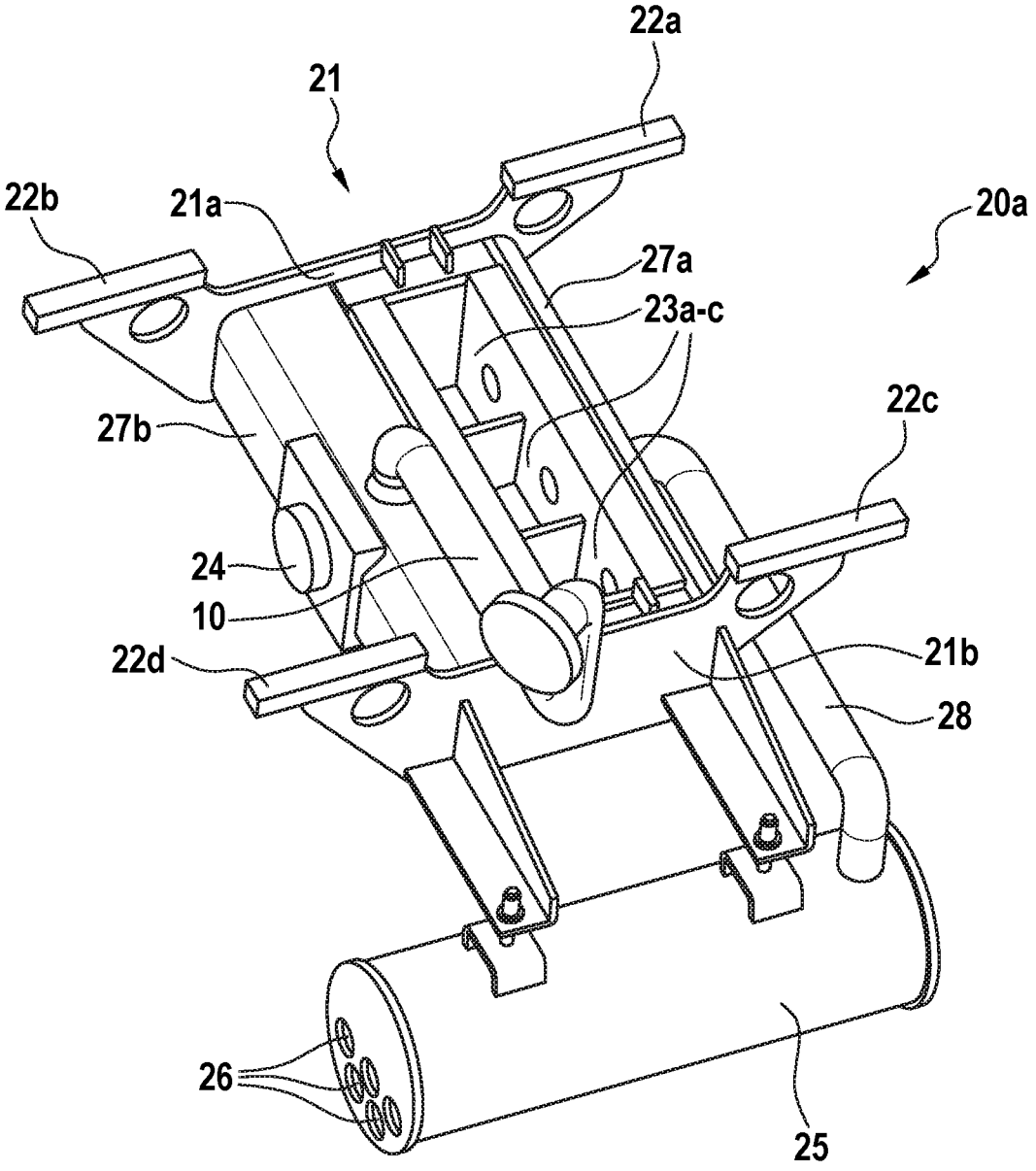
FIG. 2 is a perspective view of the inner structure of a spinning beam.

The modular assembly 20*a* according to FIG. 2 substantially comprises a suspension 21 which has at least two cross-members 21*a*, 21*b*, between which the heat chambers 27*a*, 27*b* and the openings 23*a*, 23*b*, 23*c* for the spin packs having the spinnerets are arranged. It will be seen that, in this embodiment, the spinning beam 1 is designed for three spin packs each having a spinneret, since each opening 23*a*, 23*b*, 23*c* is able to receive one spin pack. However, the spinning beam 1 can also be designed for only one spin pack, two spin packs, or for more than three spin packs. The spin packs are thus arranged one behind the other in the longitudinal direction of the spinning beam 1, in order to produce a variable number of spin-drawing systems. The heat chambers 27*a*, 27*b* are an integral part of the suspension 21 and connect the cross-members 21*a*, 21*b* together, so that a self-supporting modular assembly 20*a* is formed within the spinning beam 1. In order that the heat transfer medium is able to circulate, the heat chambers 27*a*, 27*b* are so connected to one another in the region of the cross-members 21*a*, 21*b* that the spin packs are also heated evenly on two further sides, the front faces. Supports 22*a*-22*d* with which the modular assembly 20*a* can be suspended in the frame 2 or in a framework are arranged on the cross-members 21*a*, 21*b*. On the opposite side to the heat chambers 27*a*, 27*b*, the boiler 25 is arranged horizontally on the cross-member 21*b*. For this purpose, angle profiles are in this embodiment arranged on a front face of the cross-member 21*a*, 21*b*, to which angle profiles the boiler 25 is adjustably fixed. The boiler 25 is so positioned, horizontally, that the openings 26 for the heating rods are accessible from a passage of a framework without further disassembly. For this purpose, the boiler 25 is arranged transversely, or perpendicularly, to a long side 2*b* of the frame 2, or to the long side 2*b* of the spinning beam 1. A further pipe 10 conveys the heat transfer medium away from the heat chamber 27*b* to the condenser 9.

The modular assembly 20*a* thus comprises the suspension 21, which is connected by the two cross-members 21*a*, 21*b* to the heat chambers 27*a*, 27*b* arranged therebetween. The heat chamber 27*a* is connected via a pipe 28 to the boiler 25, which is likewise part of the modular assembly 20*a*. A further part of the modular assembly 20*a* is the pump 24, which is arranged horizontally at or in the region of the heat chamber 27*b* and supplies extruded plastics material to all the spinnerets integrated into the assembly, and the pipe 10. The cross-members 21*a*, 21*b* further have supports 22*a*-22*d*, at which the modular assembly 20*a* can be suspended and fixed in the frame 2 or in a framework.

The pump 24, which is connected to the drive 4 via a shaft 5, is supplied via the pipe 12 with liquid plastics material from an extruder arranged outside the spinning beam 1. For this purpose, the liquid plastics material is guided via the flange connection 11 to the pump 24 and by the pump via further pipes to the spinnerets. It is an advantage that all the pipes that guide liquid plastics material to the spinnerets are arranged vertically, so that the liquid melt is prevented from flowing back to the extruder or to the pump 24 when components are replaced. Inside the pipes for liquid plastics material, for example the pipe 12, mixers which thoroughly mix the molten plastics material can be integrated at one or more locations.

Figure 3:
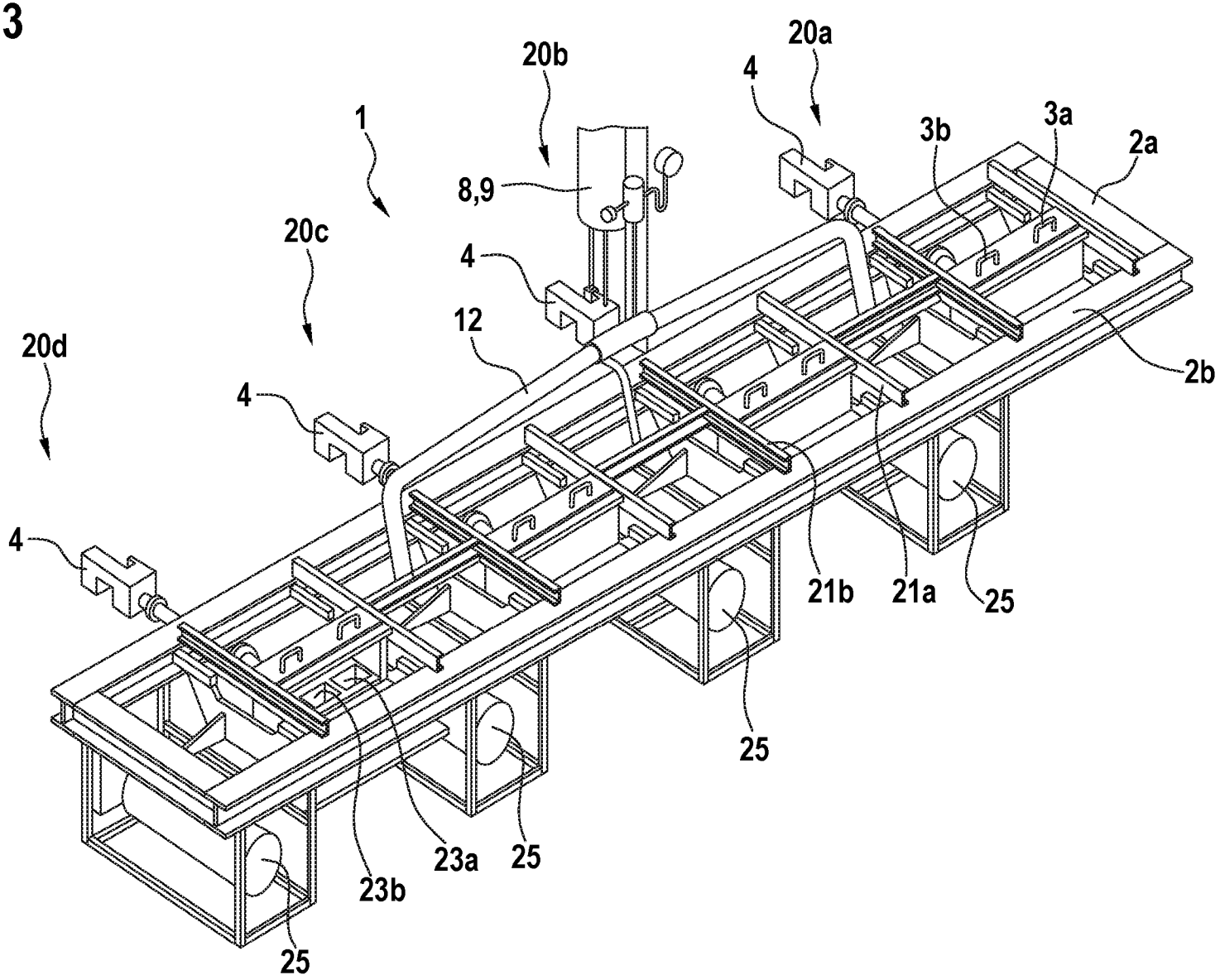
FIG. 3 is a perspective view of a spinning beam having a plurality of modular assemblies arranged side by side.
Figure 4:
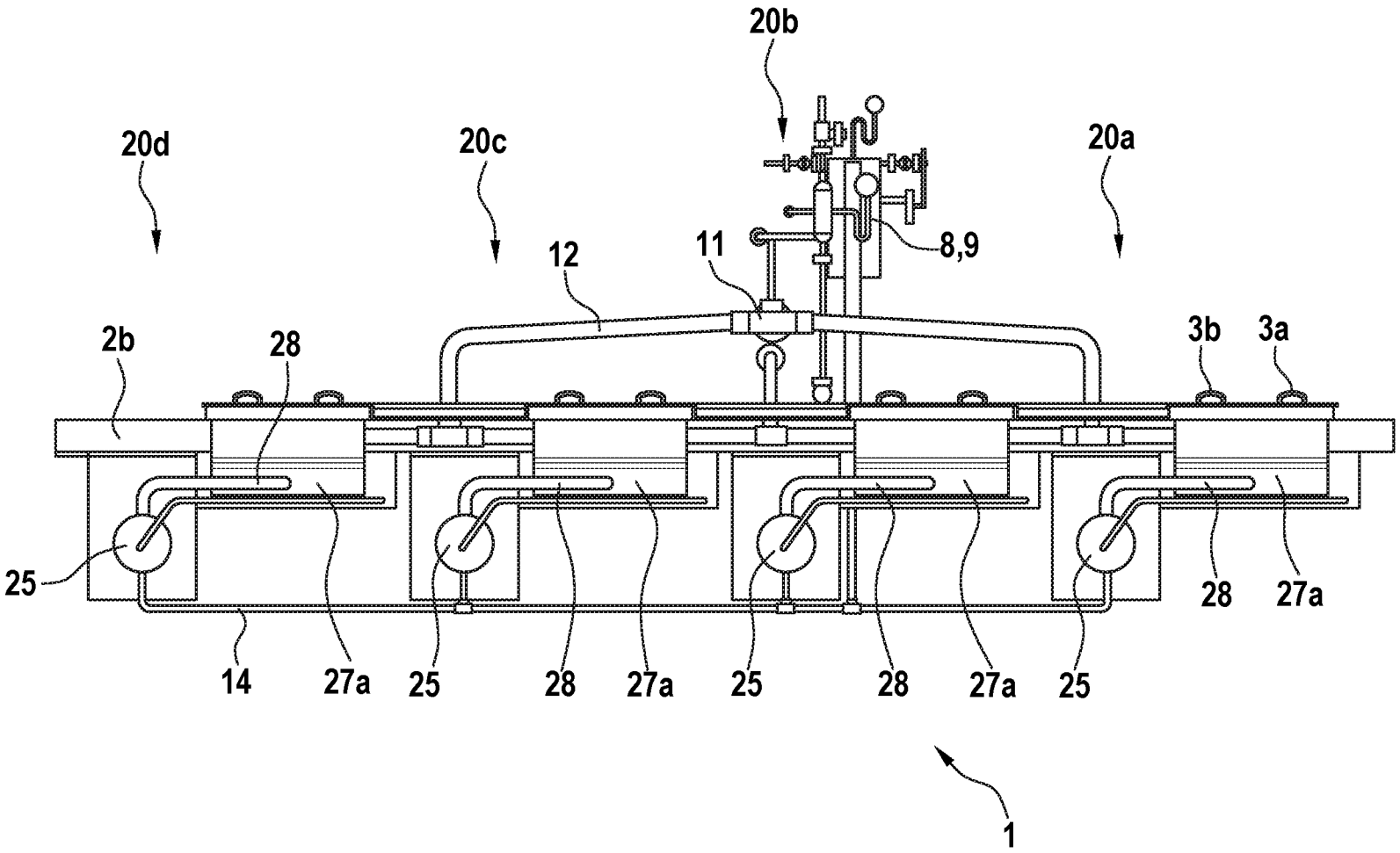
FIG. 4 is a side view of a spinning beam having a plurality of modular assemblies arranged side by side.

In the embodiment of FIGS. 3 and 4, four modular assemblies 20*a*, 20*b*, 20*c*, 20*d* are arranged on a frame 2 and form the spinning beam 1. Each modular assembly 20*a*-20*d* is suspended in the frame 2 with the two cross-members 21*a*, 21*b*, the supports 22*a*-22*d* resting on and being connected to a profile of the frame 2. In this embodiment, each modular assembly 20*a*-20*d* is able to receive two spin packs each having a spinneret, which can be installed in the openings 23*a*, 23*b* and closed by the covers 3*a*, 3*b*. Beneath the covers 3*a*, 3*b*, the spin packs can be insulated to the top by installable heating blocks which have a peripheral seal in order to avoid a chimney effect inside the opening 23*a*, 23*b*. The spin packs are arranged in parallel between the long sides 2*b* of the frame 2. A vacuum station 8 and a condenser 9 are connected to all the boilers 25 via pipes for the heat circuit of all the assemblies, a pipe 28 guiding the heat transfer medium from each boiler 25 to the heat chambers 27*a*. The boilers 25 are connected to one another via a pipe 14, so that the same heating circuit is obtained for each modular assembly 20*a*-20*d*, even in the case of a multiple arrangement. All the spin packs are supplied with liquid plastics material from an external extruder via a single flange connection 11. For this purpose there is provided a pipe 12 which, starting from the flange connection 11, guides the liquid plastics material to the pumps 24. The front side of the spinning beam 1, in the region of which the drives 4 are arranged, is easily accessible to the operating personnel for maintenance of the pumps 24, so that the heating rods in the boilers 25 can also be exchanged from this side. For this purpose, the boilers 25 are arranged horizontally and transversely, or perpendicularly, to the long side 2*b* of the frame 2. Because the pump 24 is also arranged horizontally and transversely, or perpendicularly, to the long side of the spinning beam 1, the entire spinning beam 1 can be maintained from one position. The two measures, namely the horizontal arrangement of the boiler 25 and of the pump 24 transversely, or perpendicularly, to the long side of the frame 2, permit a more compact construction of the spinning beam 1, because no space is required between the spin packs or between the assemblies for maintenance of the two components. Maintenance is carried out solely from the service passage of the framework, which has sufficient space for exchanging the long heating rods and the pumps 24.

It will be understood that the above description of the present invention is susceptible to various modifications, changes and adaptations, and that the same are intended to be comprehended within the meaning and range of equivalents of the appended claims.

The invention claimed is:

1. A spinning beam for producing melt-spun filaments, comprising:

a frame;

at least one spin pack having a spinneret;

an externally arranged extruder to convey liquid plastics material;

at least one pump arranged to receive the liquid plastics material from the externally arranged extruder and to convey the liquid plastics material to the at least one spin pack;

at least one modular assembly installable and fixable singly, or in a plurality one behind the other, in the frame, wherein the at least one modular assembly includes a suspension comprising at least two cross-members;

a boiler to heat a heat transfer medium, wherein the at least one pump and the at least one spin pack are arranged to be heated by the heat transfer medium and wherein the at least one pump, the boiler and structure defining at least one opening for receiving the at least one spin pack, respectively, are arranged in the at least one modular assembly; and at least one heat chamber, wherein the cross-members are connected to the at least one heat chamber to form a supporting frame in which the at least one opening is disposed for receiving the at least one spin pack, respectively.

2. The spinning beam according to claim 1, wherein the frame includes a long side and the at least one pump is arranged horizontally and transversely, or perpendicularly, to the long side of the frame.

3. The spinning beam according to claim 1, wherein the frame includes a long side and the boiler is arranged horizontally and transversely, or perpendicularly, to the long side of the frame.

4. The spinning beam according to claim 1, further comprising at least one vertically arranged pipe having a flange connection to guide the liquid plastics material to the at least one pump.

5. A spinning beam arrangement including the spinning beam according to claim 1, and further comprising a framework outside of the spinning beam and a drive including a drive shaft arranged on the framework to drive the at least one pump.

6. A spinning beam arrangement including the spinning beam according to claim 1, wherein the modular assembly comprises a plurality of modular assemblies forming the spinning beam, and further comprising a vacuum station and a condenser connected by pipes to the boiler in each of the plurality of modular assemblies.

7. The spinning beam arrangement according to claim 6, further comprising the pipes connecting the boilers to one another.

* * * * *